US011028693B2

(12) United States Patent
Nie et al.

(10) Patent No.: US 11,028,693 B2
(45) Date of Patent: Jun. 8, 2021

(54) ABSORPTION-INDUCTION CONVECTIONAL DUST-CONTROLLING/REMOVING AIR/FOG CURTAIN DEVICE OF FULLY-MECHANIZED WORKING FACE AND METHOD THEREOF

(71) Applicant: SHANDONG UNIVERSITY OF SCIENCE AND TECHNOLOGY, Qingdao (CN)

(72) Inventors: Wen Nie, Qingdao (CN); Zihao Xiu, Qingdao (CN); Dawei Chen, Qingdao (CN); Peng Cai, Qingdao (CN); Huitian Peng, Qingdao (CN); Jiayi Yan, Qingdao (CN); Qiang Liu, Qingdao (CN); Bo Yang, Qingdao (CN); Tao Du, Qingdao (CN); Shibo Yang, Qingdao (CN); Haihan Zhang, Qingdao (CN); Huajun Liu, Qingdao (CN)

(73) Assignee: SHANDONG UNIVERSITY OF SCIENCE AND TECHNOLOGY, Qingdao (CN)

( * ) Notice: Subject to any disclaimer, the term of this patent is extended or adjusted under 35 U.S.C. 154(b) by 0 days.

(21) Appl. No.: 16/966,295

(22) PCT Filed: Jun. 26, 2019

(86) PCT No.: PCT/CN2019/092924

§ 371 (c)(1),
(2) Date: Jul. 30, 2020

(87) PCT Pub. No.: WO2020/215478

PCT Pub. Date: Oct. 29, 2020

(65) Prior Publication Data

US 2021/0047927 A1 Feb. 18, 2021

(30) Foreign Application Priority Data

Apr. 24, 2019 (CN) ..... 201910331301.5

(51) Int. Cl.

| | |
|---|---|
| ***E21F 5/00*** | (2006.01) |
| ***E21F 5/20*** | (2006.01) |
| ***E21C 27/02*** | (2006.01) |
| ***E21F 5/04*** | (2006.01) |

(52) U.S. Cl.

CPC ..... *E21F 5/20* (2013.01); *E21C 27/02* (2013.01); *E21F 5/04* (2013.01)

(58) Field of Classification Search

CPC ..... E21F 5/02; E21F 5/04; E21F 5/20

See application file for complete search history.

(56) References Cited

U.S. PATENT DOCUMENTS

| | | | | |
|---|---|---|---|---|
| 4,358,160 A * | 11/1982 | Kissell | ..... | E21C 35/22 299/12 |
| 5,518,299 A * | 5/1996 | Adamczyk | ..... | E21C 35/223 299/12 |
| 2017/0122106 A1* | 5/2017 | Chugh | ..... | B05B 7/0884 |

FOREIGN PATENT DOCUMENTS

| | | |
|---|---|---|
| CN | 105626134 A | 6/2016 |
| CN | 205587209 U | 9/2016 |

OTHER PUBLICATIONS

International Search Report issued in corresponding International Application No. PCT/CN2019/092924, dated Feb. 6, 2020, The State Intellectual Property Office of the P.R. China, Beijing, China.
Written Opinion issued in corresponding International Application No. PCT/CN2019/092924, dated Feb. 6, 2020, The State Intellectual Property Office of the P.R. China, Beijing, China.

(Continued)

*Primary Examiner* — Janine M Kreck
(74) *Attorney, Agent, or Firm* — Hauptman Ham, LLP

(57) ABSTRACT

An absorption-induction convectional dust-controlling/removing air/fog curtain device of a fully-mechanized working face and a method thereof, wherein the device includes an extraction type dust-purifying blower, a sector deflector, (Continued)

a shearer external spraying device and an inter-hydraulic-support spraying device. The shearer external spraying devices are mounted at both sides of a shearer body close to rocking arms of a shearer and the inter-hydraulic-support spraying devices are mounted at two un-advanced hydraulic supports and two hydraulic supports at a leeward side of a front drum of the shearer respectively. Two extraction type dust-purifying blowers symmetrically mounted at the rocking arm close to the body of the shearer are started simultaneously with their air inlets exactly facing front and rear drums of the shearer respectively, and air outlets connected with the sector deflector. With the device and the method, the working environment is improved and safe production of the coal mine is guaranteed.

1 Claim, 2 Drawing Sheets

(56) References Cited

OTHER PUBLICATIONS

Chinese Office Action issued in corresponding Chinese Patent Application No. 2019103313015, dated Dec. 4, 2019.
Chinese First Search Report issued in corresponding Chinese Patent Application No. 2019103313015, dated Nov. 26, 2019.
Notification to Grant Patent Right for Invention issued in corresponding Chinese Patent Application No. 2019103313015, dated Jan. 22, 2020.

* cited by examiner

ABSORPTION-INDUCTION CONVECTIONAL DUST-CONTROLLING/REMOVING AIR/FOG CURTAIN DEVICE OF FULLY-MECHANIZED WORKING FACE AND METHOD THEREOF

RELATED APPLICATIONS

The present application is a U.S. National Phase of International Application Number PCT/CN2019/092924, filed Jun. 26, 2019, and claims the priority of Chinese Application No. 2019103313015, filed Apr. 24, 2019.

TECHNICAL FIELD

The present disclosure relates to the technical field of coal mine dust removal, and in particular to an absorption-induction convectional dust-controlling/removing air/fog curtain device of a fully-mechanized working face and a method thereof.

BACKGROUND

Coal always provides the largest energy support to China. In the proved reserves of petrochemical energy throughout the country, petroleum and natural gas only account for 6%, and coal accounts for 94%. Coal industry makes an outstanding contribution to long-term and rapid development of national economy. With continuous improvement of comprehensive mechanization, a problem of large dust production also becomes more and more severe. Measured data shows that when dust-precipitation equipment is not started, dusts produced in different working procedures performed simultaneously at a fully-mechanized working face may exceed 4000 mg/m$^3$, which far exceeds a national standard and poses a severe threat to safe production of coal mine and physical health of workers.

To solve the current problems, scholars and experts in different countries also conduct in-depth researches. Although the implementation of measures such as coal seam water injection and spraying-precipitation at present may achieve dust precipitation effect to a certain extent, dust production is continuously increasing with the continuous improvement of mechanization, so that the existing dust control/removal measures cannot achieve obvious dust precipitation effect, especially in the working regions of shearer operators, severely endangering the physical and mental health of workers in a mining district and safe production of coal mine. Therefore, it is now very important to design a better and reasonable dust-controlling/removing device of a fully-mechanized working face and a comprehensive dust-controlling/removing method.

SUMMARY

The present disclosure provides an absorption-induction convectional dust-controlling/removing air/fog curtain device of a fully-mechanized working face and a method thereof to control dust sources of the fully-mechanized working face with a focus on effectively controlling the dusts of the working face with dust-control/removal technology during two major working procedures of shearer cutting and support advancing. The device and the method can be easily and effectively performed to achieve obvious dust control effect and thus are widely applied.

One object of the present disclosure is to provide an absorption-induction convectional dust-controlling/removing air/fog curtain device of a fully-mechanized working face according to the following technical solution.

An absorption-induction convectional dust-controlling/removing air/fog curtain device of a fully-mechanized working face includes an extraction type dust-purifying blower, a sector deflector, a shearer external spraying device and an inter-hydraulic-support spraying device. There are two extraction type dust-purifying blowers symmetrically disposed at a body of a shearer close to rocking arms; an air inlet and an air outlet are disposed on each extraction type dust-purifying blower, the air inlets both directly face front and rear drums of the shearer, and the air outlets are connected with the sector deflectors.

The shearer external spraying devices are mounted at both sides of the body of the shearer close to the rocking arms respectively and spray onto the front and rear drums at a certain angle to form a fog curtain thus perform spraying precipitation for part of dusts produced when the front and rear drums of the shearer perform cutting; the inter-hydraulic-support spraying devices are mounted at two un-advanced hydraulic supports and two hydraulic supports of a leeward side of the front drum of the shearer respectively and spray toward a coal wall at a certain angle to form a fog curtain in a machine channel space and thus prevent part of dusts from spreading pollution toward windward and leeward sides.

Another object of the present disclosure is to provide an absorption-induction convectional dust-controlling/removing method of a fully-mechanized working face, including the following steps.

At step S1, the inter-hydraulic-support spraying device and the shearer external spraying device are started to form fog curtains in corresponding positions to wrap a large amount of dusts produced during support advancing and coal cutting, so that part of dusts will precipitate after combining with fog droplets; the extraction type dust-purifying blower is started simultaneously to centrifugally remove part of high-concentration dusts produced by coal cutting of the shearer by sucking the part of dusts into the extraction type dust-purifying blower by a negative pressure generated through rotation of impellers. Pushed by blades, the air has an increased momentum, and a high-speed air current field is generated at the air outlet.

At step S2, the sector deflector connected with the air outlet spreads an original columnar air current toward a roof and a floor of a roadway respectively in a vertical space to form an air curtain with its sector area gradually increasing so as to block dusts that are not captured and precipitated by spraying. In this case, a basically-closed full-section dust-purifying air chamber is formed in a working region of a shearer operator so that a large amount of high-concentration dusts blocked by the air/fog curtain and fog droplets generated by spraying enter a goaf under induction of air current. The dusts continuously combine with the droplets to precipitate when spreading toward the leeward side. Therefore, the dusts in the goaf are prevented from returning to the working face along with the air current.

Compared with the prior art, the present disclosure has the following beneficial technical effects.

(1) According to a novel absorption-induction convectional dust-controlling/removing air/fog curtain device of a fully-mechanized working face and a method thereof of the present disclosure, spraying precipitation and absorption-induction precipitation are performed for the working region of the shearer operator in the fully-mechanized working face by the method of combination of absorption and purification, dust blocking by convectional air curtain, induction of dusts into goaf, and spraying precipitation. A series of measures taken in the entire dust-control/removal process are safe and reliable, so that the high-concentration dusts in the working region of the operator in a coal mining operation process of the fully-mechanized working face are effectively controlled, thereby creating a clean and safe production environment.

(2) It is of great practical significance for improving the working environment of workers working at the fully-mechanized working face and ensuring the safe production of coal mine.

BRIEF DESCRIPTION OF THE DRAWINGS

The present disclosure will be further described below in combination with accompanying drawings.

(1*a*), (1*b*) and (1*c*) of FIG. 1 are front views of dust precipitation effects demonstrated before and after a novel absorption-induction convectional dust-controlling/removing air/fog curtain device of a fully-mechanized working face and a method thereof are implemented according to an example of the present disclosure.

Figure 2:
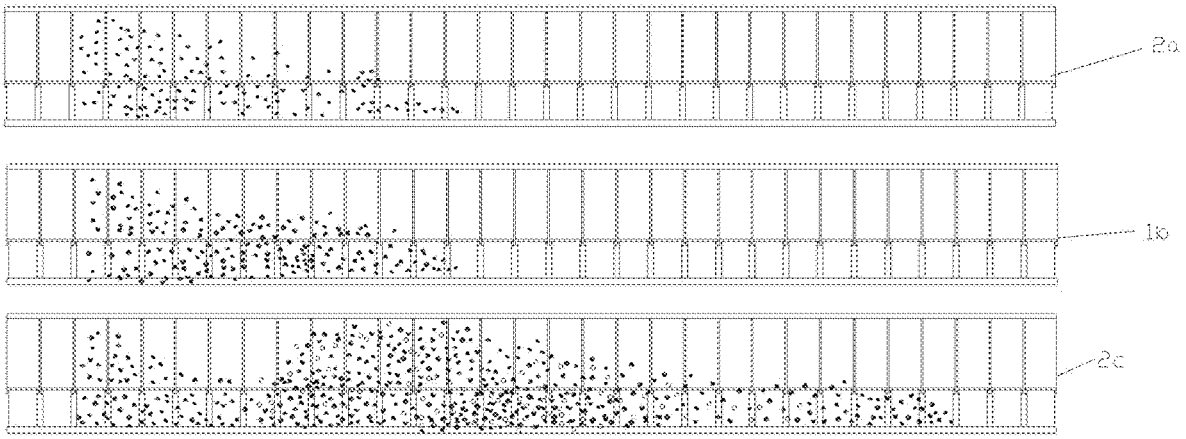

(2*a*), (2*b*) and (2*c*) of FIG. 2 are rear views of dust precipitation effects demonstrated before and after a novel absorption-induction convectional dust-controlling/removing air/fog curtain device of a fully-mechanized working face and a method thereof are implemented according to an example of the present disclosure.

Figure 3:
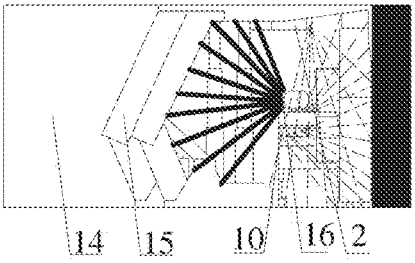

FIG. 3 is a left view after a novel absorption-induction convectional dust-controlling/removing air/fog curtain device of a fully-mechanized working face is implemented according to an example of the present disclosure.

Numerals of the drawings are described as follows:

1—inter-hydraulic-support spraying, 2—inter-hydraulic-support spraying device, 3—shearer external spraying, 4—drum, 5—dust absorption, 6—extraction type dust-purifying blower, 7—shearer, 8—operator position, 9—air curtain, 10—shearer external spraying device, 11—dust-fog coupling particle, 12—fog droplet, 13—dust particle, 14—goaf, 15—hydraulic support, 16—sector deflector, 1*a*-1*c* are front views comparing dust precipitation effects before and after implementation, and 2*a*-2*c* are rear views comparing dust precipitation effects before and after implementation.

DETAILED DESCRIPTION OF THE EMBODIMENTS

The present disclosure provides an absorption-induction convectional dust-controlling/removing air/fog curtain device of a fully-mechanized working face and a method thereof. To understand the advantages and the technical solution of the present disclosure more clearly, the present disclosure will be described in detail below in combination with specific examples.

Figure 1:
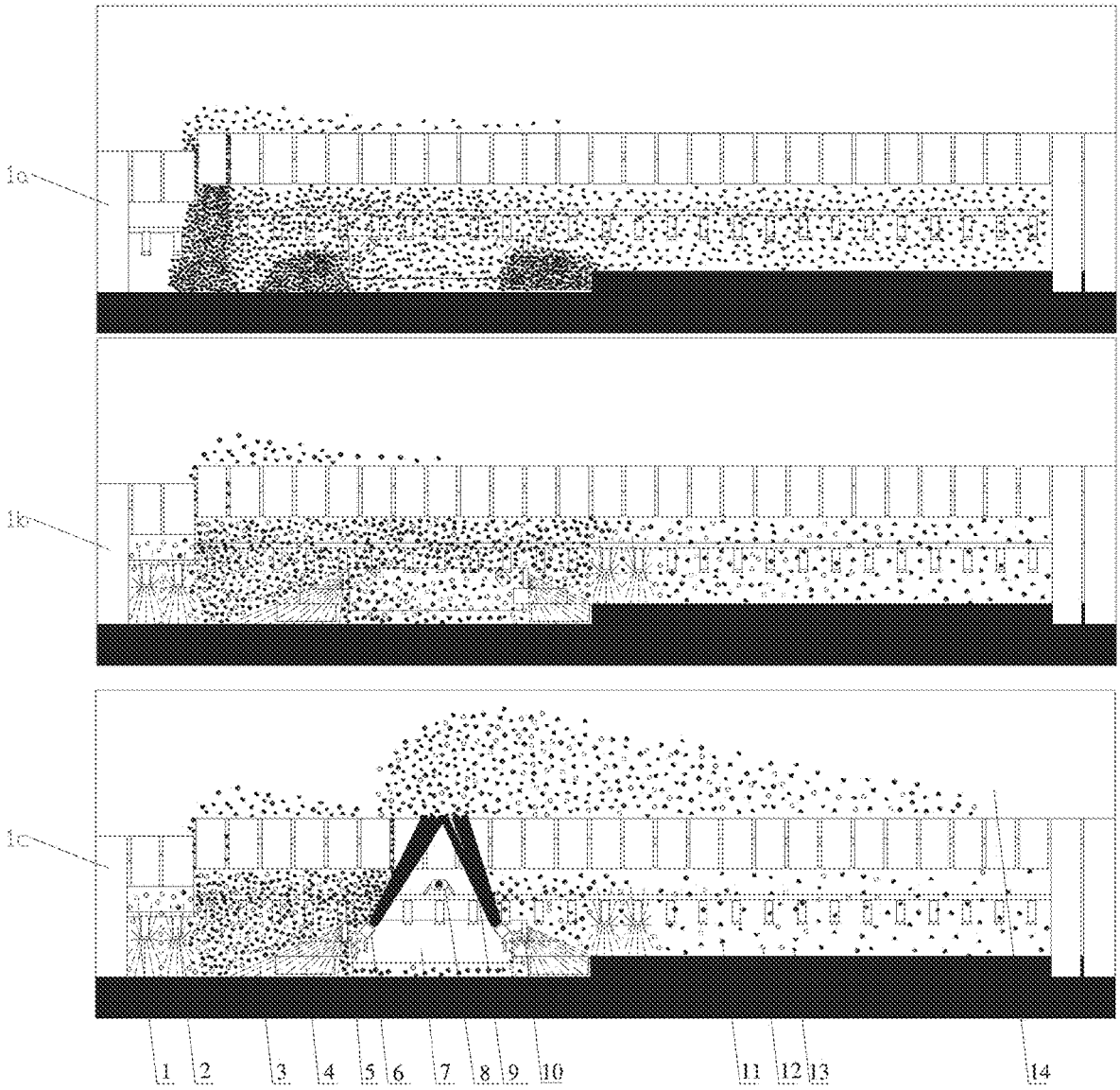

As shown in FIGS. 1-3, an absorption-induction convectional dust-controlling/removing air/fog curtain device of a fully-mechanized working face of the present disclosure includes an inter-hydraulic-support spraying device 2, a drum 4, an extraction type dust-purifying blower 6, a shearer 7, a shearer external spraying device 10, a hydraulic support 15 and a sector deflector 16. An absorption-induction convectional dust-controlling/removing air/fog curtain method of a fully-mechanized working face mainly includes a method of combination of dust absorption 5 and purification, dust blocking by a convectional air curtain 9, and induction of dust particles 13 into goaf 14, and spraying precipitation and can realize effective control for dust production of two working procedures coal cutting and support advancing by mounting corresponding devices on the shearer 7 and the hydraulic supports.

The convectional dust-controlling/removing air curtain 9 is formed under the joint action of two extraction type dust-purifying blowers 6 and a sector deflector 16. A method of blocking dust by the air curtain 9 includes: symmetrically mounting two extraction type dust-purifying blowers 6 at a body of the shearer 7 close to a rocking arm, where air inlets directly face front and rear drums 4 of the shearer 7 respectively and air outlets are connected with the sector deflector 16. When the blower is started, part of dusts produced when the drum 4 of the shearer performs cutting are sucked into the air inlet, a basically-closed full-section dust-purifying air chamber is formed at an operator position 8 of the shearer due to formation of the sector air curtain 9 at the air outlet so as to prevent the dusts from entering the working region of the operator as possible. The comprehensive dust-controlling device on the entire shearer 7 is started or stopped along with the shearer.

The shearer external spraying devices 10 are mounted at both sides of the body of the shearer 7 close to the rocking arms and spray onto the front and rear drums 4 at a certain angle to form a fog curtain and thus perform spraying precipitation for part of dusts produced when the front and rear drums 4 of the shearer perform cutting; the inter-hydraulic-support spraying devices 2 are mounted at two un-advanced hydraulic supports 15 and two hydraulic supports of a leeward side of the front drum of the shearer respectively and spray toward a coal wall at a certain angle to form a fog curtain in a machine channel space and thus prevent part of dusts from spreading pollution toward windward and leeward sides. Air-fog curtain formed by combining the air curtain 9 formed by the extraction type dust-purifying blower 6 with the fog droplets generated by spraying may induce dust particles 13 and fog droplets 12 into the goaf while blocking dusts, so that part of dust particles 13 in the goaf 14 are continuously wrapped by the droplets 12 14 when spreading toward the leeward side. Thus, dust-fog coupling particles 11 are formed to accelerate precipitation of dusts in the goaf during spreading.

The novel absorption-induction convectional dust-controlling/removing method of a fully-mechanized working face is performed as follows: fog curtains are formed at corresponding positions by starting inter-hydraulic-support spraying 1 and shearer external spraying 3 to wrap a large amount of dusts produced during support advancing and coal cutting, so that part of dust particles 13 combine with the fog droplets 12 to precipitate so as to substantially reduce dust pollution toward a sidewalk; the extraction type dust-purifying blower 6 is started simultaneously to centrifugally remove part of high-concentration dusts produced by coal cutting of the shearer 7 by sucking the part into the extraction type dust-purifying blower by a negative pressure generated through rotation of impellers; pushed by blades, the air has an increased momentum, and a high-speed air current field is generated at the air outlet; the sector deflector 16 connected with the air outlet spreads an original columnar air current toward a roof and a floor of a roadway respectively in a vertical space to form an air curtain 9 with its sector area gradually increasing so as to further block dusts that are not captured and precipitated by the shearer external spraying 3 and the inter-hydraulic-support spraying 1; the basically-closed full-section dust-purifying air chamber is formed in the working region of the shearer operator by the convectional air curtain 9 generated by the blower 6 so as to effectively reduce threat posed by the high-concentration dusts to physical and mental health of the shearer operator 8; the dust particles 13 and the fog droplets 12 generated by the inter-hydraulic-support spraying 1 and the shearer external spraying 3 are induced into the goaf 14 while a large amount of dusts blocked by the air curtain 9 spread pollution toward the leeward side. In this way, the dusts in the goaf are continuously wrapped by the fog droplets 12 during spreading, thereby accelerating the dust precipitation and preventing the dusts in the goaf 14 from returning to the working face along with the air current.

In the present disclosure, a series of measures taken in the entire dust-control/removal process are safe and reliable, so that the dusts produced in the coal mining process of the fully-mechanized working face, especially the high-concentration dusts produced in the working region of the shearer operator can be effectively controlled, thereby creating a clean and safe production environment for workers.

Parts unmentioned in the present disclosure may be realized by adopting or referring to the prior art.

It is to be noted that any equivalents or obvious modifications made by those skilled in the art under the teachings of the present specification shall be encompassed in the scope of protection of the present disclosure.

The invention claimed is:

1. An absorption-induction convectional dust-controlling/removing method of a fully-mechanized working face using an absorption-induction convectional dust-controlling/removing air/fog curtain device of a fully-mechanized working face, comprising an extraction type dust-purifying blower, a sector deflector, a shearer external spraying device and an inter-hydraulic-support spraying device, wherein, there are two extraction type dust-purifying blowers symmetrically disposed at a body of a shearer close to rocking arms respectively; an air inlet and an air outlet are disposed on each of the extraction type dust-purifying blowers, the air inlets both directly face front and rear drums of the shearer, and the air outlets are connected with the sector deflectors;

the shearer external spraying devices are mounted at both sides of the body of the shearer close to the rocking arms and spray onto the front and rear drums at a certain angle to form a fog curtain and thus perform spraying precipitation for part of dusts produced when the front and rear drums of the shearer perform cutting;

the inter-hydraulic-support spraying devices are mounted at two un-advanced hydraulic supports and two hydraulic supports at a leeward side of the front drum of the shearer respectively and spray toward a coal wall at a certain angle to form a fog curtain in a machine channel space so as to prevent part of dusts from spreading pollution toward windward and leeward sides;

sequentially comprising the following steps:

at step S1, forming fog curtains at corresponding positions by starting the inter-hydraulic-support spraying device and the shearer external spraying device to wrap a large amount of dusts produced during support advancing and coal cutting, such that part of dusts combine with fog droplets to precipitate; starting the extraction type dust-purifying blowers simultaneously to centrifugally remove part of high-concentration dusts produced by coal cutting of the shearer by sucking the part of high-concentration dusts into the extraction type dust-purifying blowers through a negative pressure generated by rotation of impellers, wherein air has an increased momentum under push of blades and a high-speed air current field is formed at the air outlet; and at step S2, by the sector deflector, spreading an original columnar air current toward a roof and a floor of a roadway respectively in a vertical space to form an air curtain with a sector area gradually increasing, so as to block dusts that are not captured and precipitated by spraying; and forming a basically-closed full-section dust-purifying air chamber in a working region of a shearer operator to induce a large amount of high-concentration dusts blocked by the air-fog curtain and fog droplets generated by spraying into a goaf through air current, so that the dusts continuously combine with the fog droplets to precipitate during spreading toward the leeward side so as to prevent the dusts in the goaf from returning to the working face along with the air current.

* * * * *